US007425709B2

(12) United States Patent
Siegfried et al.

(10) Patent No.: US 7,425,709 B2
(45) Date of Patent: Sep. 16, 2008

(54) MODULAR ION SOURCE

(75) Inventors: Daniel E. Siegfried, Fort Collins, CO (US); David Matthew Burtner, Fort Collins, CO (US); Scott A. Townsend, Fort Collins, CO (US); Valery Alexeyev, Moscow (RU)

(73) Assignee: Veeco Instruments, Inc., Woodbury, NY (US)

( * ) Notice: Subject to any disclaimer, the term of this patent is extended or adjusted under 35 U.S.C. 154(b) by 754 days.

(21) Appl. No.: 10/896,746

(22) Filed: Jul. 21, 2004

(65) Prior Publication Data

US 2005/0057167 A1 Mar. 17, 2005

Related U.S. Application Data

(60) Provisional application No. 60/489,476, filed on Jul. 22, 2003.

(51) Int. Cl.
*H01J 27/00* (2006.01)

(52) U.S. Cl. ..... 250/423 R; 315/111.81; 315/111.91; 250/423 F; 250/424; 250/426

(58) Field of Classification Search ..... 315/111.81, 315/111.91; 250/424, 426, 423 R–423 F
See application file for complete search history.

(56) References Cited

U.S. PATENT DOCUMENTS 3,353,853 A * 11/1967 Heywood ..... 403/376
3,955,118 A * 5/1976 Flemming ..... 315/111.81
4,423,355 A * 12/1983 Kageyama ..... 315/111.81
4,531,077 A * 7/1985 Dagenhart ..... 315/111.81
4,542,321 A * 9/1985 Singh et al. ..... 315/111.81
5,640,020 A 6/1997 Murakoshi et al.
5,763,989 A 6/1998 Kaufman
5,877,593 A * 3/1999 Langford et al. ..... 315/111.31
6,002,208 A 12/1999 Maishev
6,037,717 A 3/2000 Maishev
6,130,507 A 10/2000 Maishev
6,147,354 A 11/2000 Maishev
6,153,067 A 11/2000 Maishev
6,182,604 B1 * 2/2001 Goeckner et al. ..... 118/723 E
6,214,183 B1 4/2001 Maishev (Continued)

OTHER PUBLICATIONS

Dr. John Keem, High Current Density Anode Layer Ion Sources, 44th Annual Technical Conference Proceedings, 2001, pp. 1-6, Society of Vacuum Coaters.

(Continued)

*Primary Examiner*—Jack I. Berman
*Assistant Examiner*—Andrew Smyth
(74) *Attorney, Agent, or Firm*—Hensley Kim & Holzer, LLC

(57) ABSTRACT

A modular ion source design relies on relatively short modular core ALS components, which can be coupled together to form a longer ALS while maintaining an acceptable tolerance of the anode-cathode gap. Many of the modular components may be designed to have common characteristics so as to allow use of these components in ion sources of varying sizes. A flexible anode can adapt to inconsistencies in the ion source body and module joints to hold a uniform anode-cathode gap along the length of the ALS. A clamp configuration fixes the cooling tube to the ion source body, thereby avoiding heat-introduced warping to the source body during manufacturing.

39 Claims, 7 Drawing Sheets

U.S. PATENT DOCUMENTS

| | | | | |
|---|---|---|---|---|
| 6,236,163 | B1 | 5/2001 | Maishev | |
| 6,238,526 | B1 | 5/2001 | Maishev | |
| 6,242,749 | B1 | 6/2001 | Maishev | |
| 6,246,059 | B1 | 6/2001 | Maishev | |
| 6,250,250 | B1 | 6/2001 | Maishev | |
| 6,359,388 | B1 | 3/2002 | Petrmichl | |
| 6,368,664 | B1 | 4/2002 | Veerasamy | |
| 6,395,333 | B2 | 5/2002 | Veerasamy | |
| 6,454,901 | B1 | 9/2002 | Sekiya | |
| 6,454,910 | B1 | 9/2002 | Zhurin | |
| 6,777,030 | B2 | 8/2004 | Veerasamy | |
| 6,808,606 | B2 | 10/2004 | Thomsen | |
| 6,815,690 | B2 | 11/2004 | Veerasamy | |
| 7,023,128 | B2 * | 4/2006 | Madocks | 313/359.1 |
| 2002/0117250 | A1 * | 8/2002 | Veerasamy | 156/101 |

OTHER PUBLICATIONS

D. Burtner, Linear Anode-Layer Ion Sources With 340- and 1500-mm Beams, 46th Annual Technical Conference Proceedings, May 2003, pp. 61-66, Society of Vacuum Coaters.

V. Dudnikov, Ion Source With Closed Drift Anode Layer Plasma Acceleration, Review of Scientific Instruments, Feb. 2002, pp. 729-731, vol. 73 No. 2, American Institute of Physics.

V. Zhurin, Physics of Closed Drift Thrusters, Plasma Sources Sci. Technol. 8, 1999, pp. R1-R20, IOP Publishing Ltd., UK.

N. Vershinin, Hall Current Accelerator For Pre-Treatment of Large Area Glass Sheets, Coatings on Glass, 1999, pp. 283-286.

V. Baranov, Energy Model and Mechanisms of Acceleration Layer Formation For Hall Thrusters, 33rd Joint Propulsion Conference, Jul. 1997, pp. 1-8, AIAA 97-3047, Reston, VA.

A. Zharinov, Acceleration of Plasma by a Closed Hall Current, Soviet Physics—Technical Physics, Aug. 1967, pp. 208-211, vol. 12 No. 2, Russia.

A. Semenkin, Investigation of Erosion in Anode Layer Thrusters and Elaboration High Life Design Scheme, 23rd Intl Electric Propulsion Conf., Sep. 1993, pp. 1-6, IEPC-93-231.

L. Lou, Application Note: Ion Source Precleaning, Advanced Energy, Mar. 2001, pp. 1-4, Fort Collins, CO.

Plasma Surface Engineering Corporation, Compound Ion Beam-Magnetron Sputtering Source, Product Specification: I-Mag, Feb. 2003, pp. 1-5, San Diego, CA.

A. Shabalin, Whitepaper: Industrial Ion Sources and Their Application for DLC Coating, SVC 42nd Annual Technical Conference, Jan. 2001, pp. 1-4, Fort Collins, CO.

Advanced Energy, Ion Beams Sources, [online], Aug. 2002, [retrieved on Dec. 6, 2004], Retrieved from the Advanced Energy company website using Internet <URL: http://www.advanced-energy.com/upload/sl-ion-230-02.pdf>, pp. 1-6, Fort Collins, CO.

VECOR, Vacuum Equipment Coatings and Optics from Russia, [online], last updated on Apr. 22, 2004, [retrieved on Dec. 6, 2004], Retrieved from the Advanced Energy company website using Internet <URL: http://www.vecorus.com/welcom.htm>, Moscow, Russia.

VECOR, Vacuum Equipment Coatings and Optics from Russia, Magnetrons Ion Sources and Accessories, [online], last updated on Apr. 22, 2004, [retrieved on Dec. 6, 2004], Retrieved from the Advanced Energy company website using Internet <URL: http://www.vecorus.com/magionsource.htm>, Moscow, Russia.

* cited by examiner

MODULAR ION SOURCE

RELATED APPLICATIONS

This application claims benefit of U.S. Provisional Application No. 60/489,476 entitled "Modular Anode Layer Source having a Flexible Anode" and filed on Jul. 22, 2003, incorporated herein by reference for all that it discloses and teaches.

In addition, this application relates to U.S. patent application Ser. No. 09/900,506 entitled "Ion Source Allowing Longitudinal Cathode Expansion" and U.S. patent application Ser. No. 10/896,747 entitled "Modular Uniform Gas Distribution System in an Ion Source", both filed on Jul. 21, 2004 and incorporated herein by reference for all that they disclose and teach.

TECHNICAL FIELD

The invention relates generally to ion sources, and more particularly to a modular ion source.

BACKGROUND

Anode Layer Sources (ALSs) produce and accelerate ions from a thin and intense plasma called the "anode layer". This anode layer forms adjacent to an anode surface of an ALS due to large Hall currents, which are generated by the interaction of strong crossed electric and magnetic fields in the plasma discharge (gap) region. This plasma discharge region is defined by the magnetic field gap between cathode pole pieces (also called the "cathode-cathode gap") and the electric field gap between the downstream surface of the anode and the upstream surface of the cathode (also called the "anode-cathode gap"). A working gas, including without limitation a noble gas, oxygen, or nitrogen, is injected into the plasma discharge region and ionized to form the plasma. The electric field accelerates the ions away from the plasma discharge region toward a substrate.

In one implementation of a linear ALS, the anode layer forms a continuous, closed path exposed along a race-track-shaped ionization channel in the face of the ion source. Ions from the plasma are accelerated primarily in a direction normal to the anode surface, such that they form an ion beam directed roughly perpendicular to the ionization channel and the face of the ion source. Different ionization channel shapes may also be employed.

For typical etching or surface modification processes, a substrate (such as a sheet of flat glass) is translated through the ion beam in a direction perpendicular to the longer, straight sections of the ionization channel. Uniform etching across the substrate, therefore, depends on the ion beam flux and energy density being uniform along the length of these straight channel sections. Variations in the ion beam flux and energy density uniformity along the straight channel sections can significantly degrade the longitudinal uniformity of the resulting ion beam.

Non-uniformities in the anode-cathode gap can have a significant negative effect on the longitudinal ion beam uniformity and can be introduced in various ways during manufacturing. For example, the ion source body can be warped by the welding or brazing of a cooling tube to the outside surface of the ion source body, thus introducing anode-cathode gap variations.

Minor gap variations can result in substantial longitudinal beam current density variations. A typical ALS geometry has an anode-cathode gap of 2 mm, a cathode-cathode gap of 2 mm, and a cathode face height of 2 mm, which is also known as a 2×2×2 mm geometry. Measurements of a linear ALS using this geometry have shown that variations of 0.3 mm in the anode-cathode gap dimension can cause longitudinal beam current density variations of 8%. It should be understood that alternative ALS configurations and dimensions may also be employed. Non-uniformities in the cathode-cathode gap and the working gas distribution to the anode layer can also negatively influence ion beam uniformity.

A typical ALS design includes a rigid monolithic anode supported on insulators in a cavity of a rigid monolithic source body. Both the anode and the source body are cut from stainless steel stock and are precisely machined to the desired dimensions. Rough machining and welding-induced or brazing-induced distortion during assembly often dictate that the flat surfaces of the source body and anode undergo a final precision machining operation in order to hold the desired gap dimension tolerance.

This manufacturing process has provided good results for relatively short ion sources (e.g., 300 mm long). However, some ALS applications can require very long ion sources (e.g., 2540 mm to 3210 mm). For example, some architectural glass processing applications can require an ALS that is about twelve feet long (i.e., 3657.6 mm). Such length can make it extremely difficult and prohibitively expensive to maintain the required uniformity of the anode-cathode gap over the entire length of the ALS. Therefore, using traditional monolithic designs and manufacturing techniques for long ALSs is undesirable and potentially infeasible.

SUMMARY

Implementations described and claimed herein address the foregoing problems by providing a modular ion source design and modular ion source manufacturing techniques. The modular ion source design relies on relatively short modular core ALS components, which can be coupled together to form a longer ALS while maintaining an acceptable tolerance of the anode-cathode gap. For long ion sources, these shorter modular components allow manufacturing method that are more feasible and less expensive than the monolithic approaches and further result in a final assembly having better precision (e.g., uniform gap dimensions along the longitudinal axis of the ion source). Many of the modular components may be designed to have common characteristics so as to allow use of these components in ion sources of varying sizes. A flexible anode can adapt to minor variabilities and changes in the ion source assembly and module joints, thereby holding a uniform anode-cathode gap along the length of the ALS. In another implementation, rather than welding or brazing a cooling tube to the ion source body, a clamp configuration fixes the cooling tube to the ion source body, thereby avoiding heat-introduced warping during manufacturing.

In one implementation, a method is provided that assembles a modular ion source. Multiple source body modules are assembled into a modular source body forming a cavity along a longitudinal axis of the modular source body. A flexible anode is installed in the cavity along the longitudinal axis of the modular source body. A cathode along the longitudinal axis of the modular source body.

In another implementation, a modular ion source is assembled. Multiple source body modules are assembled into a modular source body forming a cavity along a longitudinal axis of the modular source body. A cooling tube is clamped along the longitudinal axis of the modular source body.

In another implementation, an ion source is provided. A cathode extends along a longitudinal axis of the ion source.

Multiple thin-walled tubes are connected into a closed-path anode positioned relative to the cathode to form a substantially uniform anode-cathode gap along the longitudinal axis of the ion source.

In yet another implementation, a modular ion source is provided. A modular ion source body includes a plurality of source body modules joined at module joints spaced along a longitudinal axis of the modular ion source. Multiple clamp plates bolt to one or more of the source body modules and bridge the module joints.

In yet another implementation, an ion source includes an anode and a cathode. An ion source body supports the cathode and includes a cavity holding the anode. A cooling tube extends longitudinally along the ion source. Multiple clamp plates fixed to the ion source body and clamp the cooling tube against the ion source body to cool the ion source.

Other implementations are also described and recited herein.

BRIEF DESCRIPTIONS OF THE DRAWINGS

DETAILED DESCRIPTIONS

Figure 1:
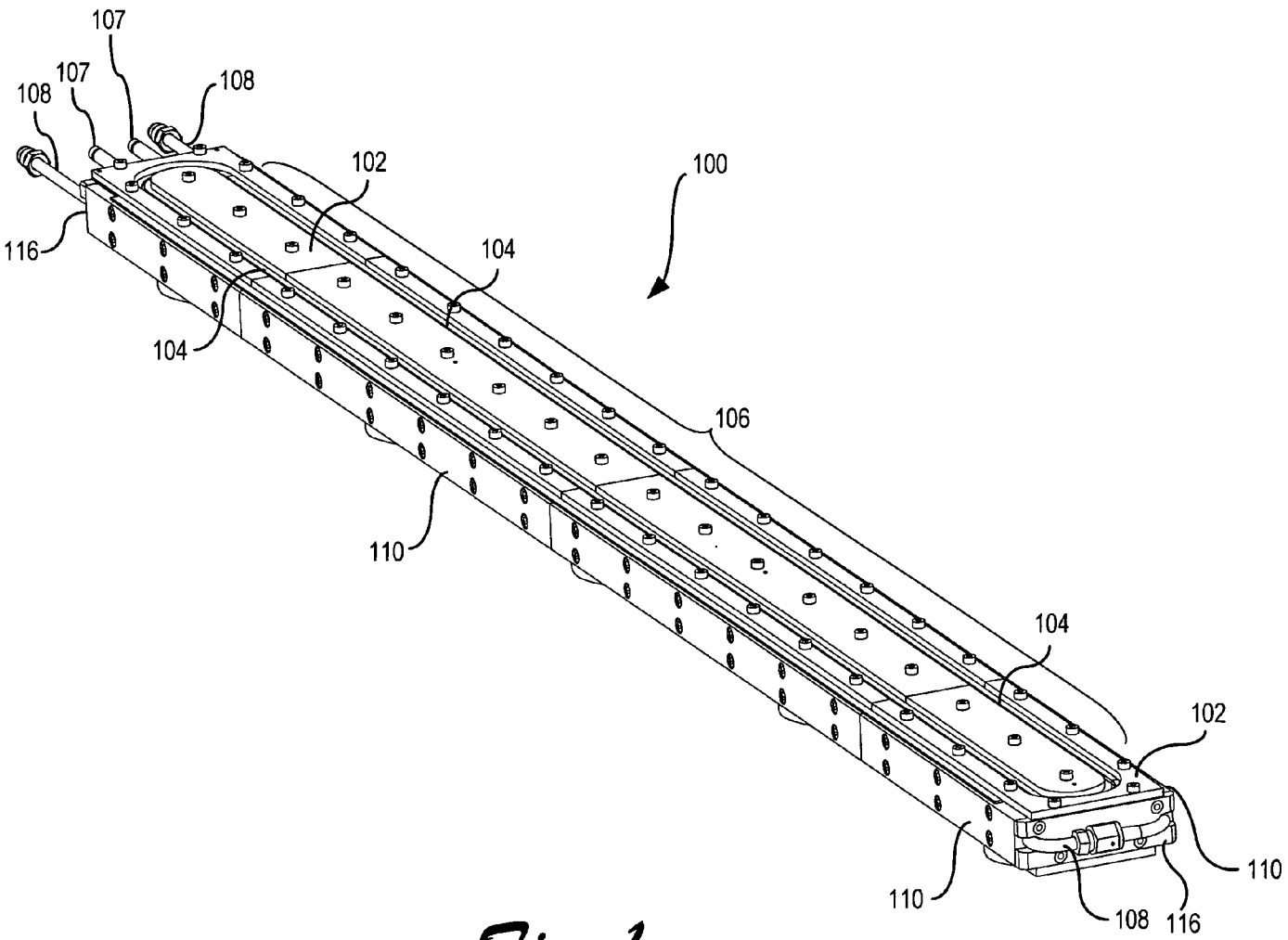
FIG. 1 illustrates an exemplary modular ALS.

FIG. 1 illustrates an exemplary modular ALS 100. Cathode covers 102 are affixed to the ALS 100 to form an opening for a race-track-shaped ionization channel 104. The cathode covers 102 may be monolithic or modular, although the illustrated implementation employs modular cathode covers.

The anode and the cathode of the ALS 100 are located beneath the cathode covers 102. In one implementation, the anode is tied to a high positive potential and the cathode is tied to ground in order to generate the electric field in the anode-cathode gap, although other configurations of equivalent polarity may be employed. A magnetic circuit is established through the source body to the cathodes using permanent magnets to form a magnetic field in the cathode-cathode gap. The interaction of strong crossed electric and magnetic fields in this gap region ionizes the working gas and accelerates the ions in an ion beam from the anode layer toward a target (e.g., toward a substrate). Generally, the target is passed through the portion of the ion beam generated by the longitudinal section 106 of the ALS 100 to maximize the uniformity of the ion beam directed onto the target.

The ALS 100 is manufactured from modular components. To facilitate use of common component modules in ion sources having different lengths, typical substrate widths for various ion beam applications were considered. Some typical substrate widths for web coating and flat glass applications are 1.0 m, 1.5 m, 2.54 m, and 3.21 m. As such, a common source body module length of 560 mm was determined to provide ion sources with suitable beam lengths to cover all of these sizes, in addition to covering a 2.0 m ion source. However, it should be understood that different module lengths may also be employed, and in some applications, the modules lengths may differ substantially within the same modular ion source.

The source body modules are bound together by the clamp plates 110 and other structures in the ALS 100 so as to provide overall rigidity along the length of the ALS 100 (i.e., along the longitudinal axis of the ion source). In addition, a flexible anode, which is less rigid than a traditional rigid monolithic anode, is sufficiently flexible to allow the anode to follow any discontinuities or warpage along the length of the ALS 100, thereby contributing to the uniformity of the anode-cathode gap. End plates 116 close off each end of the ALS 100.

The plasma and the high voltage used to bias the anode of the ALS 100 generate a large amount of heat, which can damage the ion source and undermine the operation of the source. Accordingly, the anode is cooled by a coolant (e.g., water) pumped through cooling tubes 107 to a hollow cavity within the anode. Furthermore, a cooling tube 108 assists in cooling the cathode and source body of the ALS 100 by conducting the heat away from the ion source body through a coolant (e.g., water), which is pumped through the cooling tube 108. The cooling tube 108 may be constructed from various materials, including without limitation stainless steel, copper, or mild steel. The clamp plates 110 press the cooling tube 108 against the side of the body of the ALS 100 to provide the thermally conductive contact for cooling the source, without welding or brazing the cooling tube 108 to the ion source body. In at least one implementation, the clamp plates 110 overlap the joints between ion source body modules to provide structural rigidity and alignment force along the length of the ALS 100.

In one implementation, an easily compressible material with high conductivity (such as indium foil) is compressed between the cooling tube 108 and the source body. The material conforms between the source body and the cooling tube 108 to improve heat conduction from the body of the ALS 100 to the coolant, although other heat conducting materials may also be employed, such as flexible graphite.

Alternatively, no added material is required between the cooling tube 108 and the source body. In one implementation, grooves in the source body and the clamp plates 110 are sized to compress the cooling tube 108 with enough force to cold work or deform the tube 108 against the source body, thereby providing an adequate thermally conductive contact to efficiently cool the source body and the cathode.

Figure 2:
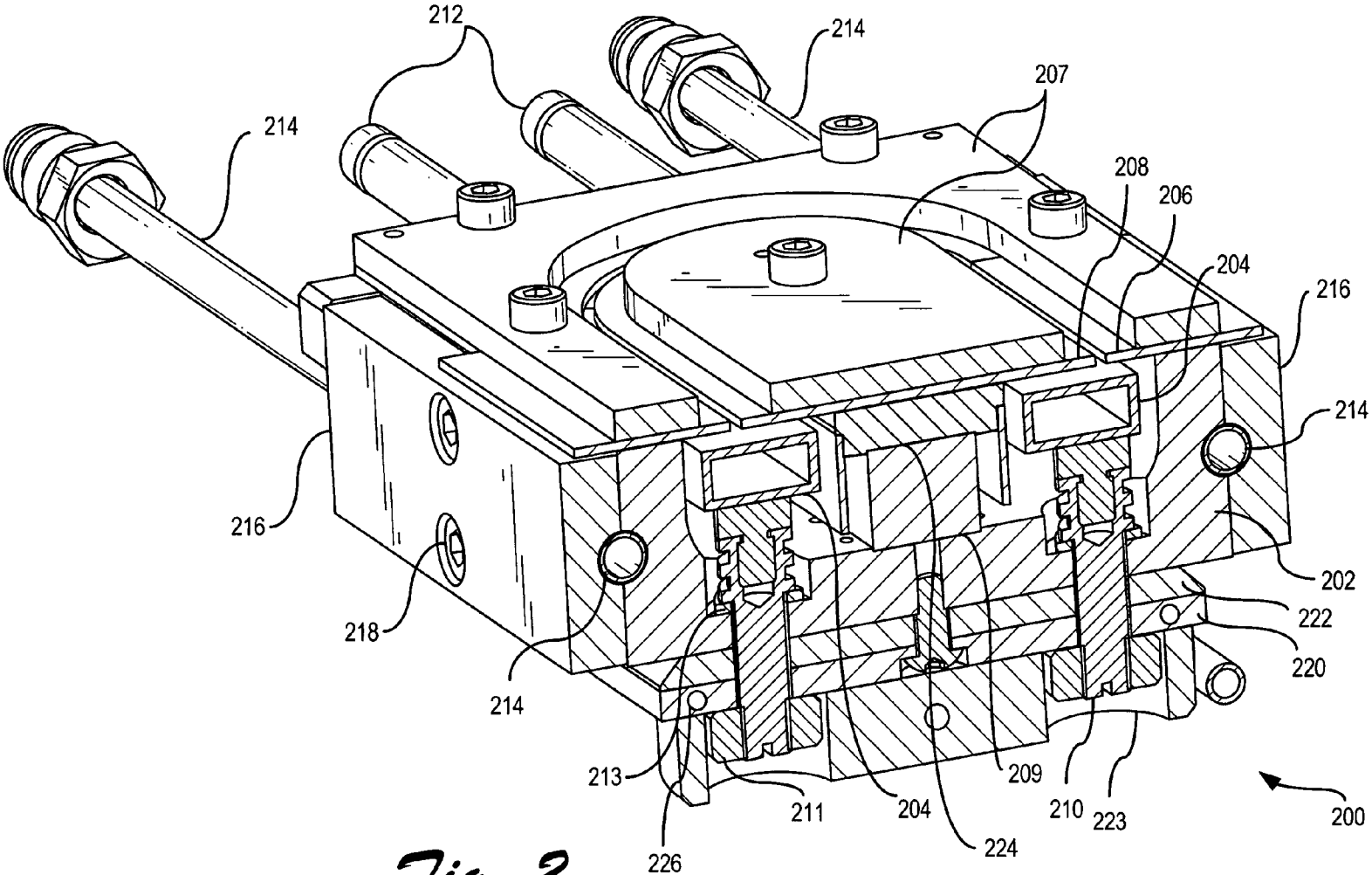
FIG. 2 illustrates a cross-sectional view of an exemplary modular ALS.

FIG. 2 illustrates a cross-sectional view of an exemplary modular ALS 200. An end module of an ion source body 202 of the ALS's body forms a roughly U-shaped cavity in which the anode 204 is located. Additional source body modules (not shown) extend the cavity down the length of the ALS 200.

The two cathode plates 206 and 208 form the cathode of the ALS. The separation between the cathode plates 206 and 208 establishes the cathode-cathode gap. A magnetic circuit is driven by a magnet 209, through the source body module 202, to each of the cathode plates 206 and 208. Cathode covers 207 clamp the cathode plates 206 and 208 to the source body module 202 and magnet covers 224 and define an opening for the race-track-shaped ionization channel.

As shown in FIG. 2, the anode 204 is fabricated from a thin-walled stainless steel tubing in order to provide the desired flexure along the anode's length. Tubing sections are welded together to form a rectangular-shaped anode that lies under the opening at the ionization channel. In one implementation, the tubing is commercially available 300 series thin walled rectangular tubing (0.375"×0.75"×0.060" wall), although other specifications and dimensions are also contemplated, including tubing with a height of 0.125"-0.5", a width of 0.5"-1.0", and a wall thickness of 0.02"-0.09". Accordingly, the anode 204 is comparatively flexible in the Y-axis (i.e., the ion beam axis), so it will easily conform to irregularities along the source body. Furthermore, the tubing walls are thick enough to prevent "ballooning" of the tubing during operation and to prevent overall distortion of the anode's rectangular shape.

The anode 204 is mounted to a series of anode insulator posts 210, which supports the anode 204 at the proper height to achieve the desired uniform anode-cathode gap dimension. The insulator posts 210 are spaced close enough together (e.g., ~<200 mm) along the anode 204 to prevent sagging or distortion of the anode 204. The insulator posts 210 are fixed in place during operation by insulator nuts 211 and precision machined spacers 213. (Note: In some implementations, spacers are not employed because other components are precision machined to achieve the desired anode-cathode gap dimension.) The anode insulator posts 210 may have a fixed height relative to the interior surface of the source body module 202 or the height of the posts 210 can be changed during manufacturing to tune the anode-cathode gap to within a specified tolerance along the length of the ALS 200. Where the posts 210 are adjustable, they are generally fixed after manufacture and during operation.

The anode 204 includes a hollow conduit to allow the flow of anode coolant (e.g., water) provided by anode cooling tubes 212. Another cooling tube 214 is clamped to the source body module 202, as well as the other source body modules in the ALS 200 to provide additional cooling capacity to the source body module 202 and the cathode 206/208. The cooling tube 214 is pressed into thermally conductive contact with the source body modules by clamp plates 216 and clamp screws 218.

A working gas, which is ionized to produce the plasma, is distributed under uniform controlled pressure within the cavity of the source body module 202. A modular gas distribution plate 220, in combination with gas distribution manifolds (such as manifold 223), uniformly distributes the gas into a gas baffle plate 222, which directs the gas through flow holes in the source body module 202. The modular gas distribution plate 220 also includes precision drilled pin holes 226 to facilitate alignment of adjacent modular gas distribution channels along the length of the ALS 200.

Figure 3:
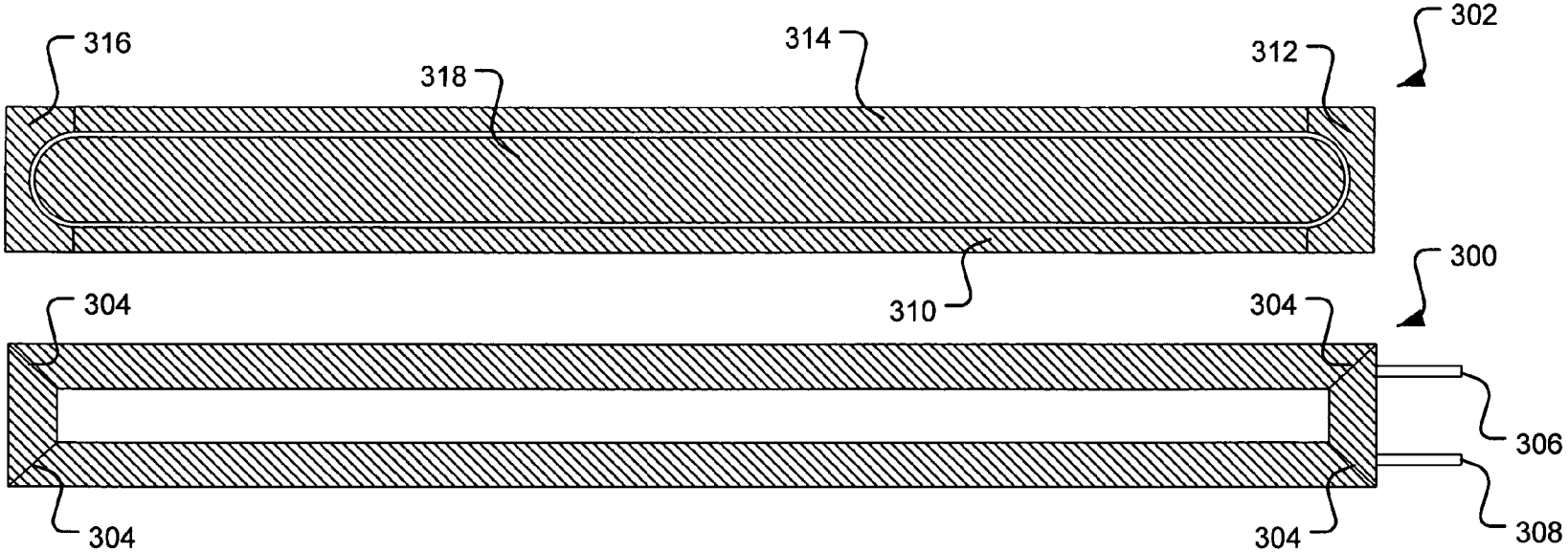
FIG. 3 illustrates a flexible anode and a modular cathode configuration of an exemplary modular ALS.

FIG. 3 illustrates a flexible anode 300 and a modular cathode configuration 302 of an exemplary modular ALS. The flexible anode 300 is fabricated from four non-magnetic stainless steel tube segments, which are welded together at mitered corners 304 to form the rectangular anode path, such as shown in FIG. 3. Cooling tubes 306 and 308 transfer coolant through the hollow channels in the anode tube segments to provide cooling capacity to the anode 300.

The cathode configuration 302 is fabricated from a plurality of cathode plates module 310, 312, 314, 316, and 318 stamped from magnetic stainless steel. The separation between the cathode plate module 318 and the other cathode plate modules forms the cathode-cathode gap through which the ions accelerate from the anode layer toward the target. It should be understood that the cathode plate 318 could also be modular and that all of the cathode plates can be larger or smaller or shaped differently than illustrated. In one implementation, the cathode plates are secured by pressure applied by the cathode covers, which are screwed to the source body or magnet covers. Longitudinal expansion of the cathode plate modules may still be allowed by a pin and enlarged slot interface between the cathode plates and the cathode covers. In another implementation, the cathode plate modules are themselves screwed to the source body and the magnet covers.

Generally, the use of an anode fabricated from stainless steel tubing, instead of a monolithic anode cut from a stainless steel slab, also reduces fabrication costs. The tubing is readily available from stock in 20-foot sections at a relatively low cost. Tubing sections are easily fabricated into an appropriately dimensioned anode by butt-welding the tubing at mitered corners. Furthermore, the hollow characteristic of the tubing provides a ready-made internal channel for coolant flow, as opposed to the stainless steel slab configuration that requires complex machining to form a channel within the traditional monolithic anode.

Figure 4:
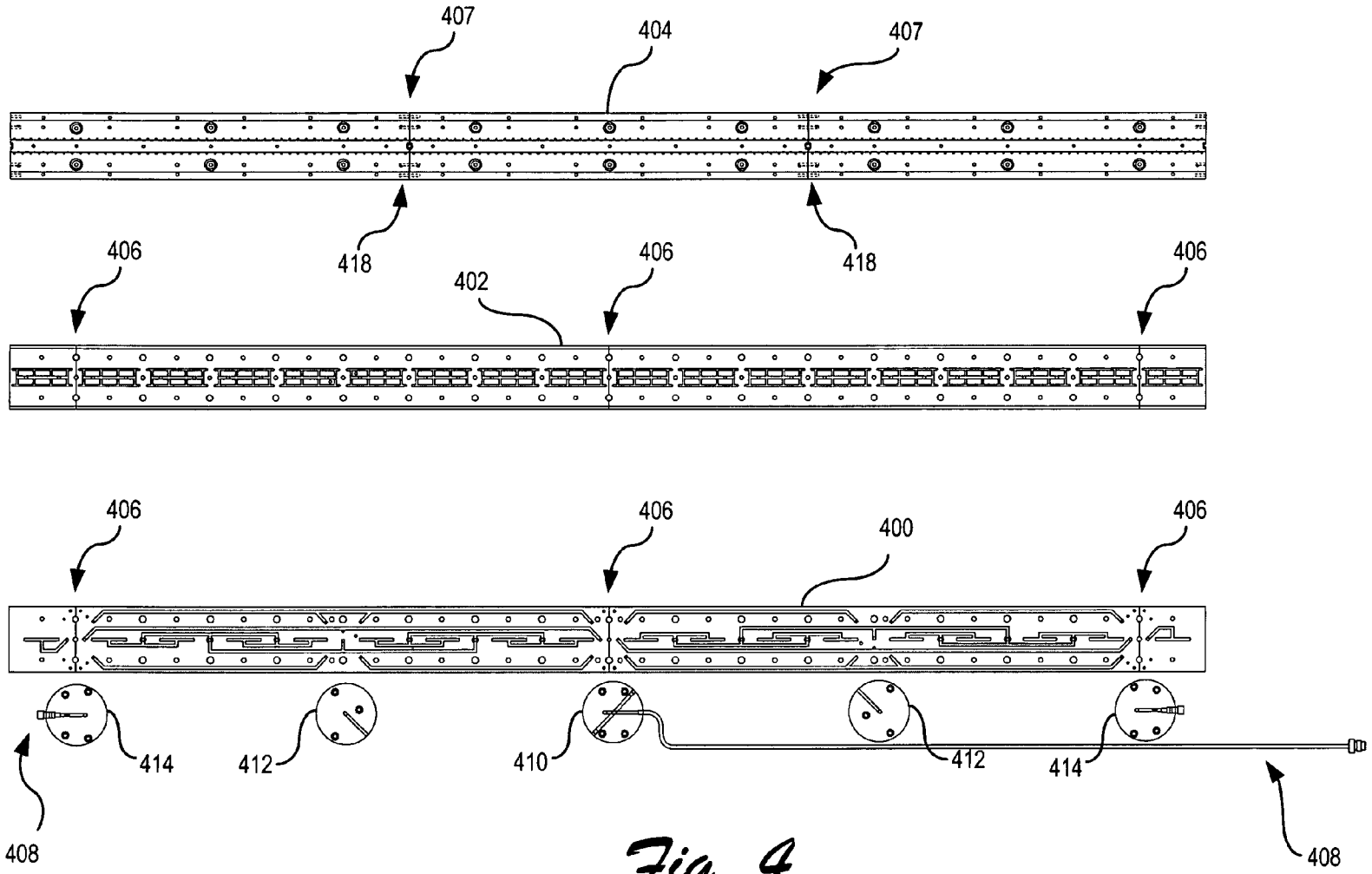
FIG. 4 illustrates a modular gas distribution plate, a modular gas baffle plate, and a modular source body in an exemplary modular ion source.

FIG. 4 illustrates a modular gas distribution plate 400, a modular gas baffle plate 402, and a modular source body 404 in an exemplary modular ion source. Joints between component modules are shown at 406, and joints between component source body modules are shown at 407. The various modules are joined into a sealed pressure fit by virtue of the overlapping plates and screws used in assembly. It should also be noted that the gas distribution plate 400 and the gas baffle plate 402 include end modules 408 to offset their joints relative to the joints of the modular source body 404, thereby providing overlapping support across the joints of the modular source body 404 and improving the overall rigidity of the modular ion source. In addition, alternative modular configurations may be employed.

The illustrated source body joints modules are aligned using pins 418. The pins 418 are inserted into precision drilled holes in the joint edge surfaces of the source body modules. When the modular ion source is assembled, the source body modules are pressed tightly together by the supporting plates, including in some implementations, clamping plates, the gas distribution and baffle plates, the cathode plates, and the cathode cover plates. Accordingly, the joints are weld-free, avoiding warping effects attributable to welding operations. The precision drilled holes are aligned by pins 418 to force the corresponding source body modules into alignment along the shared pins. This alignment assists the maintenance of a uniform anode-cathode gap along the length of the modular ion source. Pins (not shown) may also be used to align the gas distribution plate modules along the length of the modular ion source.

The gas supply channels of the gas distribution plate 400 are designed to distribute the working gas at controlled pressure uniformly over the length of the modular ion source. As such, the gas supply channels are distributed in a bifurcated distribution tree within each module, and gas distribution manifolds, such as gas entry manifold 410, bridge the joint between two gas distribution plate modules without gas leakage. Other gas distribution manifolds, such as feeder manifold 412, evenly distribute the working gas into the bifurcated tree of each gas distribution plate module. In addition, other gas distribution manifolds, such as end manifold 414, distribute the working gas into the ends of the ion source through a control value (such as a needle value). The control valve allows the gas flow to be increased/decreased to provide uniform gas distribution to the end of the ion source, despite having different topology and volume than a common linear interior module. In an alternative embodiment, the gas feeder manifolds and gas entry manifolds may also include needle values, particularly if non-symmetrical gas input is needed to achieve uniform gas distribution to the plasma discharge region.

Figure 5:
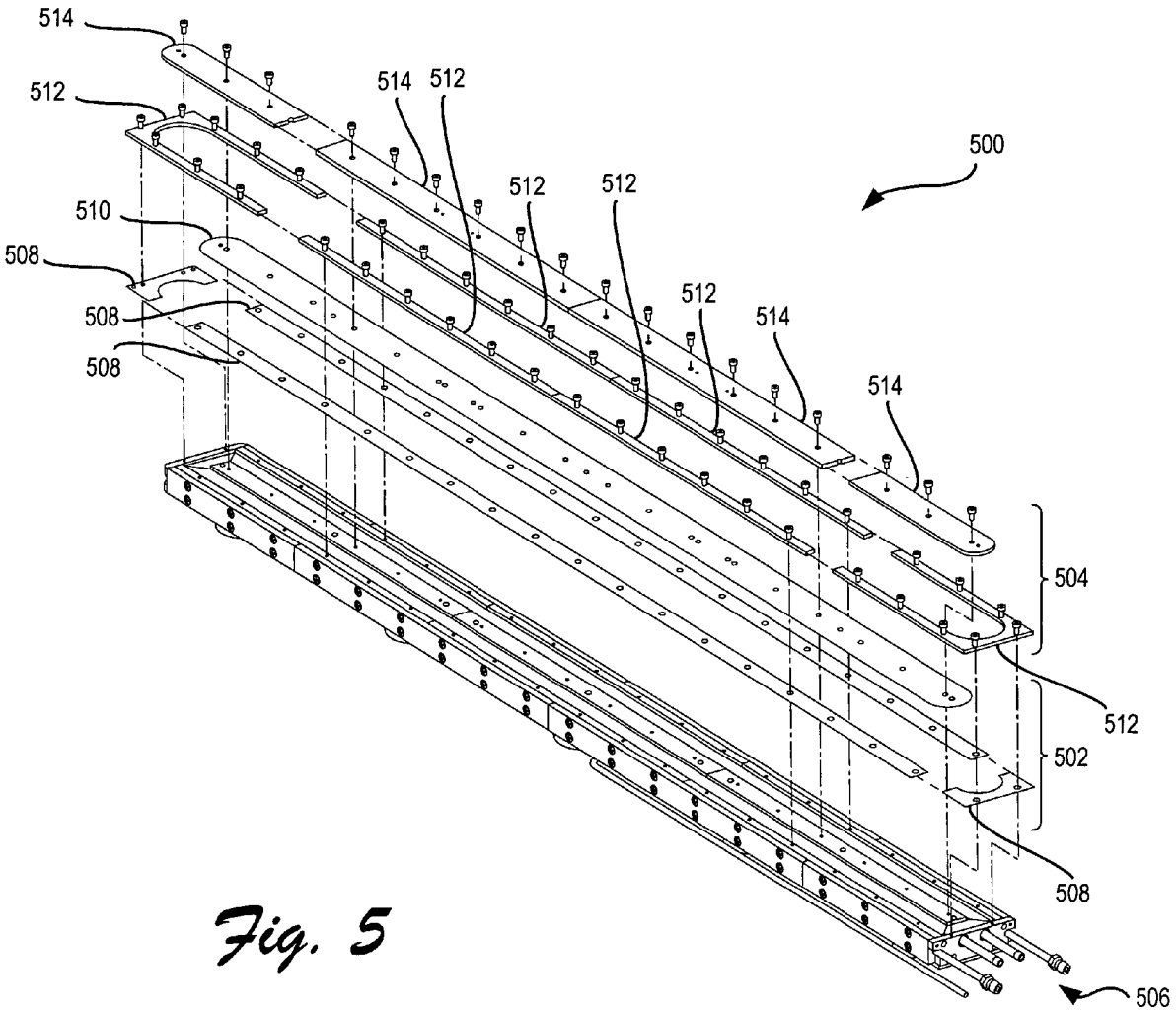
FIG. 5 illustrates a partially exploded view of an exemplary modular ALS.

FIG. 5 illustrates a partially exploded view of an exemplary modular ALS. A modular cathode 502 and a modular cathode cover 504 are show in relation to a modular source body/anode assembly 506. Notably, the outer cathode plates 508 and the inner cathode plate 510 form the modular cathode 502. It should also be understood that the inner cathode plate could also include multiple cathode module plates. Likewise, the outer cathode covers 512 and the inner cathode covers form the modular cathode cover 504.

During operation, the active edge of the cathode becomes worn over time, necessitating periodic replacement of the worn cathode plates. The illustrated configuration, however, reduces the frequency of outer cathode plate replacement. The use of a cathode cover 504, which is offset from the ionization channel relative to the cathode plate 504, allows the cathode plate 504 to be flat and symmetrical, as opposed to the thicker, tapered cathodes that are traditionally used in ALSs. As such, the longitudinal segments of the outer cathode plate 508 may be symmetric along the length of the ion source. This configuration allows the longitudinal cathode segment to be turned around to expose a second unworn edge into the cathode-cathode gap, doubling the life of the cathode plate.

The use of cathode cover plates 504 also allows the cathode plate modules to be manufactured from lower cost methods and materials than traditional methods. In the illustrated configuration, the cathode plate modules can be stamped, water-cut, or laser-cut from thin stainless steel plates, rather than requiring precision machining from thick steel slabs. This feature is particularly advantageous in that the cathode plates are worn significantly over time during operation and, therefore, require periodic replacement.

Figure 6:
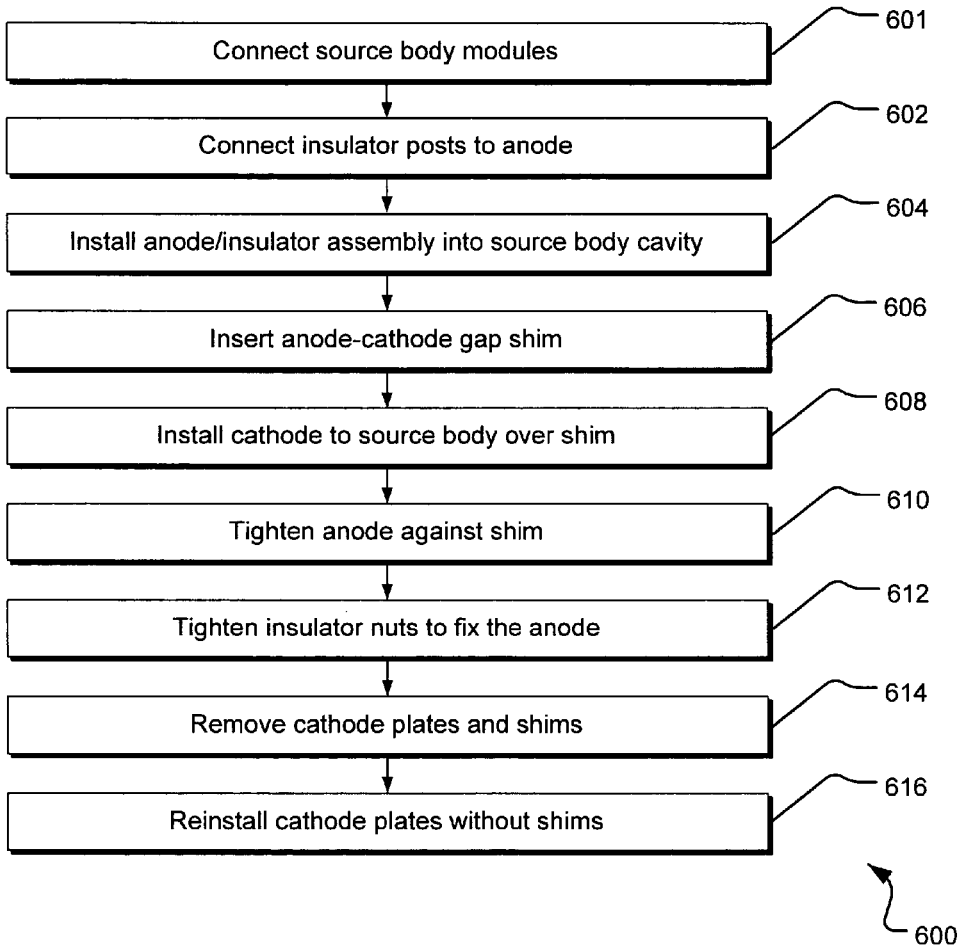
FIG. 6 illustrates exemplary operations for manufacturing a modular ALS having a flexible anode configuration.

FIG. 6 illustrates exemplary operations 600 for manufacturing a modular ALS having a flexible anode configuration. An assembly operation 601 connects a plurality of source body modules to form a modular source body. A connecting operation 602 assembles the insulator posts finger tight to the anode. An installation operation 604 installs the anode/insulator assembly into the source body cavity of the assembled module ion source body. Ends of the insulator posts are inserted through the base of the source body and loosely secured by insulator nuts at the underside of the source body.

A shimming operation 606 inserts an anode-cathode gap shim on top of the anode. The shim is machined to the desired anode-cathode gap thickness. An installation operation 608 installs one or more cathode plates to the top of the source body and the magnet cover, and tightens the plates into place to press the shim against the anode.

A tightening operation 610 tightens the anode against the shim, thereby establishing a precise anode-cathode gap. In one implementation, the tightening operation 610 includes adjusting the height to press the top face of the anode against the shim. The insulator nuts are also tightened to fix the adjusted anode height in tightening operation 612. A removal operation 614 removes the cathode plates and shims, and then a reinstallation operation 616 reinstalls the cathode plates on the ion source, thereby reestablishing the uniform anode-cathode gap.

In another implementation, several of the described operations may be omitted because the relevant dimensions of the source body, the insulator posts, and the anode are precisely controlled when initially machined and assembled so that resulting anode-cathode gap stays within the required tolerance over the length of the source body module. Using this method in a long monolithic ion source is typically too expensive and possibly infeasible, but is more manageable when applied to a much shorter module of a long modular ion source. Because of the limited modular length, the need for post-assembly machining is alleviated or reduced.

In this implementation, the anode flexibility accommodates any discontinuities or variations in source geometries potentially introduced over multiple modules so that the anode-cathode gap remains substantially uniform (i.e., within tolerance) over the length of the ion source. Therefore, one advantage to this implementation is that the shimming operation 606 anode tightening are not required because the gap uniformity is enforced by the precisely controlled dimensions within the module.

Figure 7:
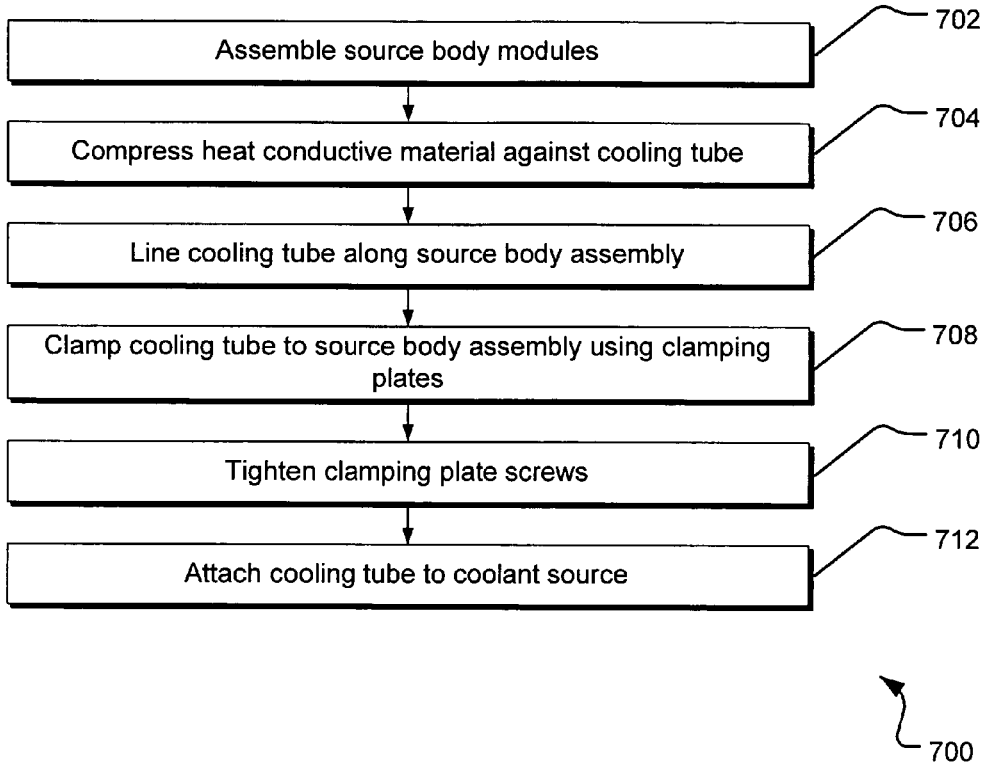
FIG. 7 illustrates exemplary operations for manufacturing a modular ALS having a clamped cooling tube configuration.

FIG. 7 illustrates exemplary operations 700 for manufacturing a modular ALS having a clamped cooling tube configuration. An assembly operation 702 assembles a plurality of source body modules. A compression operation 704 applies a heat conductive material, such as indium foil, to the cooling tube although this operation may be omitted if sufficient conductivity is achieved without the material. The application of the material to the cooling tube may range from a minimal contact between the source body and the cooling tube, to applying the material to a substantial portion of the cooling tube (e.g., the inner half of the tube that is aligned with the source body), to wrapping the entire circumference of the cooling tube.

An installation operation 706 runs the cooling tube along the length of the source body assembly. Another installation operation 708 clamps the cooling tube to the source body assembly using clamping plates. A tightening operation 710 tightens the screws in the clamping plates, securing the cooling tube firmly against the source body to achieve acceptable heat conductivity. In addition, the clamping plates, which generally overlap junctions between source body modules, contribute to the alignment and rigidity along the overall length of the ion source. An attaching operation 712 attaches the cooling tube to a coolant source to provide a flow of coolant to cool the source body during operation.

In some modes of operation, trapped air pockets within the anode cooling channel or steam formation on the surface of the anode could reduce the cooling efficiency of the anode cooling system. However, by increasing the velocity of the coolant flow within the anode tube, these effects can be mitigated. In one implementation, baffles or other interference structures can be introduced to the interior of the tubular anode to cause turbulence and improve the cooling efficiency of the anode cooling system. Alternatively, the cross-sectional area of the cooling channel in the anode tube can increase efficiency. In one implementation, a rod is inserted into the interior of the anode tube to reduce its cross-sectional area and increase the velocity of the anode coolant flow.

The above specification, examples and data provide a complete description of the structure and use of exemplary implementations of the described articles of manufacture and methods. Since many implementations can be made without departing from the spirit and scope of the invention, the invention resides in the claims hereinafter appended.

Furthermore, certain operations in the methods described above must naturally precede others for the described method to function as described. However, the described methods are not limited to the order of operations described if such order sequence does not alter the functionality of the method. That is, it is recognized that some operations may be performed before or after other operations without departing from the scope and spirit of the claims.

What is claimed is:

1. An ion source comprising:

a cathode extending along a longitudinal axis of the ion source; and a plurality of thin-walled tubes forming a closed-path anode positioned relative to the cathode to form a substantially uniform anode-cathode gap along the longitudinal axis of the ion source.

2. The ion source of claim 1 further comprising:

a plurality of aligned source body modules connected to form a modular source body of the ion source.

3. The ion source of claim 1 wherein the cathode is formed from stainless steel.

4. The ion source of claim 1 wherein the anode is formed from thin-walled stainless steel tubes.

5. The ion source of claim 1 wherein the anode is formed from non-magnetic thin-walled stainless steel tubes.

6. The ion source of claim 1 wherein the anode is flexible along the longitudinal axis of the ion source.

7. The ion source of claim 1 wherein the anode is adapted to flex in the ion beam axis along the longitudinal axis of the ion source.

8. The ion source of claim 1 wherein the cathode comprises three or more cathode plates.

9. The ion source of claim 1 further comprising:

a source body forming a cavity in which the anode is located;

a magnet cover within the cavity of the source body; and two or more cathode cover plates securing the cathode to the source body of the ion source and the magnet cover.

10. The ion source of claim 1 wherein the tubes are mitered together to form a closed rectangular-shaped anode path.

11. The ion source of claim 1 wherein the tubes provide a conduit for coolant through the anode of the ion source.

12. The ion source of claim 1 wherein the cathode includes a plurality of cathode plates and further comprising:

a modular ion source body forming a cavity having a bottom surface and two sidewalls, the sidewalls supporting one or more of the cathode plates;

a plurality of insulator posts supporting the anode within the cavity;

a magnet and a magnet cover positioned within the cavity and supporting one or more of the cathode plates, wherein the insulator posts, the anode, and the sidewalls are machined to dimensions that maintain a uniform anode-cathode gap along the longitudinal axis of the modular ion source.

13. The ion source of claim 1 wherein the cathode includes a plurality of cathode plates and further comprising:

a modular ion source body forming a cavity having a bottom surface and two sidewalls, the sidewalls supporting one or more of the cathode plates;

a magnet and a magnet cover positioned within the cavity and supporting one or more of the cathode plates; and a plurality of height-adjustable insulator posts that support the anode and have been set to maintain a uniform anode-cathode gap along the longitudinal axis of the modular ion source.

14. The ion source of claim 1 that generates an anode layer as a result of a Hall current.

15. A modular ion source comprising:

a modular ion source body including a plurality of source body modules joined at module joints spaced along a longitudinal axis of the modular ion source; and a plurality of clamp plates bolted to one or more of the source body modules and bridging the module joints.

16. The modular ion source of claim 15 wherein the source body modules are joined together at a weld-free joint.

17. The modular ion source of claim 15 wherein the source body modules are aligned by one or more pins fitting into drilled holes in the joint edge surfaces of the source body modules.

18. The modular ion source of claim 15 wherein the modular ion source is an anode layer source.

19. The modular ion source of claim 15 further comprising:

a modular gas baffle plate operably attached to the modular ion source body.

20. The modular ion source of claim 15 further comprising:

a modular gas baffle plate comprising a plurality of gas baffle plate modules.

21. The modular ion source of claim 15 further comprising:

a modular gas distribution plate operably attached to the modular ion source body.

22. The modular ion source of claim 15 further comprising:

a modular gas distribution plate comprising a plurality of gas distribution plate modules.

23. The modular ion source of claim 15 further comprising:

a modular cathode cover operably attached to the modular ion source body.

24. The modular ion source of claim 15 further comprising:

a modular cathode cover comprising a plurality of cathode cover modules.

25. The modular ion source of claim 15 further comprising:

one or more gas manifolds mounted to the modular ion source and configured to uniformly distribute a working gas within the modular ion source.

26. The modular ion source of claim 15 wherein the cathode comprises three or more cathode plates.

27. The modular ion source of claim 26 wherein the modular ion source includes a linear section between two nonlinear ends and wherein two of the cathode plates are rectangular and extend the length of the linear section of the modular ion source.

28. An ion source comprising:

a flexible thin-walled anode;

a cathode;

an ion source body supporting the cathode and having a cavity holding the anode;

a cooling tube extending longitudinally along the ion source; and a plurality of clamp plates fixed to the ion source body and clamping the cooling tube against the ion source body to cool the ion source.

29. The ion source of claim 28 wherein the ion source body is modular.

30. The ion source of claim 28 wherein the ion source is an anode layer source.

31. The ion source of claim 28 further comprising:

a heat conducting material compressed between the ion source body and the cooling tube.

32. A method of assembling a modular ion source, the method comprising:

connecting a plurality of source body modules into a modular source body forming a cavity along a longitudinal axis of the modular source body;

installing a flexible anode in the cavity along the longitudinal axis of the modular source body; and installing a cathode along the longitudinal axis of the modular source body.

33. The method of claim 32 further comprising:

connecting thin-walled tubes into a closed-path rectangular anode to form the flexible anode.

34. The method of claim 32 further comprising:

clamping a cooling tube to the modular source body.

35. The method of claim 32 further comprising:

clamping a cooling tube to the modular source body using clamp plates that overlap joints in the modular source body.

36. The method of claim 32 further comprising:

compressing a thermally conductive material between the cooling tube and the modular source body.

37. A method of assembling a modular ion source, the method comprising:

connecting a plurality of source body modules into a modular source body forming a cavity along a longitudinal axis of the modular source body; and clamping a cooling tube along the longitudinal axis of the modular source body.

38. The method of claim 37 wherein the clamping operation comprises:

clamping the cooling tube to the modular source body using clamp plates that overlap joints in the modular source body.

39. The method of claim 37 further comprising:

compressing a thermally conductive material between the cooling tube and the modular source body.

* * * * *